US007690362B2

(12) United States Patent
Pike et al.

(10) Patent No.: US 7,690,362 B2
(45) Date of Patent: Apr. 6, 2010

(54) FLANGE MOUNTED VALVE MANIFOLD

(75) Inventors: Brian J. Pike, Oxford, MI (US); Stephen J. Anderson, Livonia, MI (US); Paul F. Briggs, Grand Blanc, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 94 days.

(21) Appl. No.: 11/519,073

(22) Filed: Sep. 12, 2006

(65) Prior Publication Data

US 2007/0084445 A1 Apr. 19, 2007

Related U.S. Application Data

(60) Provisional application No. 60/726,580, filed on Oct. 14, 2005.

(51) Int. Cl.
*F02M 37/20* (2006.01)

(52) U.S. Cl. ..... 123/516; 123/541; 123/514; 123/509; 123/510

(58) Field of Classification Search ..... 123/541, 123/514, 516, 509, 510; 137/571, 592, 565; 417/360, 363, 448; 220/905, 562, 564; 280/830, 280/831

See application file for complete search history.

(56) References Cited

U.S. PATENT DOCUMENTS 4,306,844 A 12/1981 Otto et al.
4,590,964 A 5/1986 Beardmore
4,672,937 A 6/1987 Fales et al.
4,945,884 A * 8/1990 Coha et al. ..... 123/509
4,966,189 A * 10/1990 Harris ..... 137/587
4,974,570 A 12/1990 Szwargulski et al.
5,056,492 A * 10/1991 Banse ..... 123/509
5,427,074 A * 6/1995 Tuckey ..... 123/514
5,951,050 A 9/1999 Siekmann
6,182,693 B1 2/2001 Stack et al.
6,253,790 B1 7/2001 Hara
6,311,675 B2 * 11/2001 Crary et al. ..... 123/516
6,378,504 B1 4/2002 Horiuchi et al.
6,595,814 B2 7/2003 Hartke et al.
6,598,593 B1 7/2003 Kanamaru et al.
6,679,292 B2 1/2004 Ootaka et al.
7,047,997 B2 * 5/2006 Beyer et al. ..... 137/202
7,249,594 B2 * 7/2007 Hashiguchi ..... 123/509
7,281,524 B2 * 10/2007 Braun ..... 123/510
2004/0244780 A1 12/2004 Kempka et al.
2005/0039728 A1 2/2005 Krogull et al.

* cited by examiner

*Primary Examiner*—Stephen K Cronin
*Assistant Examiner*—Keith Coleman

(57) ABSTRACT

A flange assembly 10 is provided for a fuel supply unit of a vehicle. The assembly 10 includes a flange 12 constructed and arranged to cover an opening in a fuel tank. The flange has an interior portion constructed and arranged to be exposed to fuel. The interior portion is in communication with an outlet 15 provided at an exterior of the flange. A plastic manifold 16 is mounted to the interior portion of the flange so as to communicate with the outlet. The manifold is constructed and arranged to mount at least one fuel supply component 22 thereon.

14 Claims, 2 Drawing Sheets

FLANGE MOUNTED VALVE MANIFOLD

This application claims the benefit of the earlier filing date of U.S. Provisional Application No. 60/726,580, filed on Oct. 14, 2005, which is incorporated by reference herein in its entirety.

FIELD OF THE INVENTION

This invention relates to a fuel supply unit for vehicle and, more particularly, to a fuel tank flange assembly having an integral manifold.

BACKGROUND OF THE INVENTION

In fuel supply units for vehicles, a fuel tank flange is necessary to cover an opening provided in the fuel tank. The opening is necessary for inserting components into the fuel tank that are needed for the proper performance of the fuel supply unit. The fuel tank flange is often used to mount, directly thereon, certain components such as valves, ports, sensors and fasteners.

There is a need to provide, on the fuel tank flange, a fuel compatible polymeric manifold for holding single or multiple components necessary for proper fuel supply unit performance that isolates outlets of the components from the internal tank environment.

An object of the invention is to fulfill the need referred to above. In accordance with the principles of the present invention, this objective is achieved by providing a flange assembly for a fuel supply unit of a vehicle. The assembly includes a flange constructed and arranged to cover an opening in a fuel tank. The flange has an interior portion constructed and arranged to be exposed to fuel. The interior portion is in communication with an outlet provided at an exterior of the flange. A plastic manifold is mounted to the interior portion of the flange so as to communicate with the outlet. The manifold is constructed and arranged to mount at least one fuel supply component thereon.

In accordance with another aspect of the invention, a method provides a flange assembly for a fuel supply unit of a vehicle. The method provides a flange that is constructed and arranged to cover an opening in a fuel tank. The flange has an interior portion constructed and arranged to be exposed to fuel. The interior portion is in communication with an outlet provided at an exterior of the flange. The method includes mounting a plastic manifold to the interior portion of the flange so as to communicate with the outlet. At least one fuel supply component is mounted on the manifold.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawing, in which.

DETAILED DESCRIPTION OF THE EXEMPLARY EMBODIMENT

Figure 1:
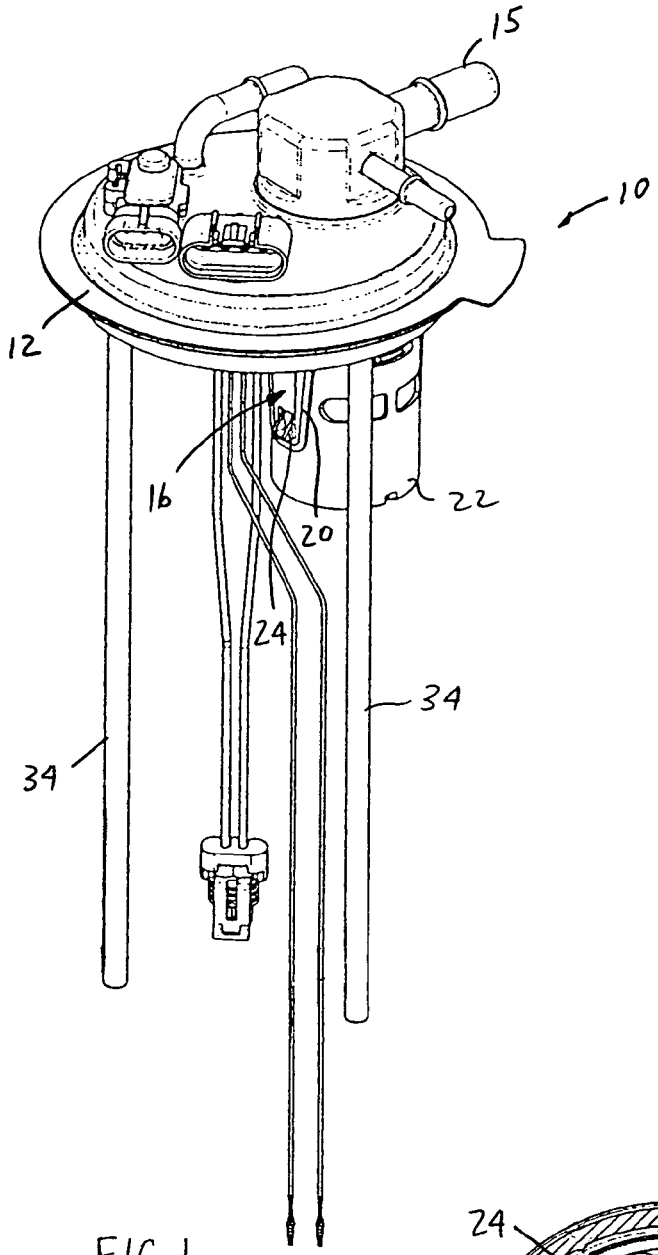
FIG. 1 is perspective view of a flange assembly shown with a plastic manifold mounted thereto in accordance with the principles of the present invention.
Figure 2:
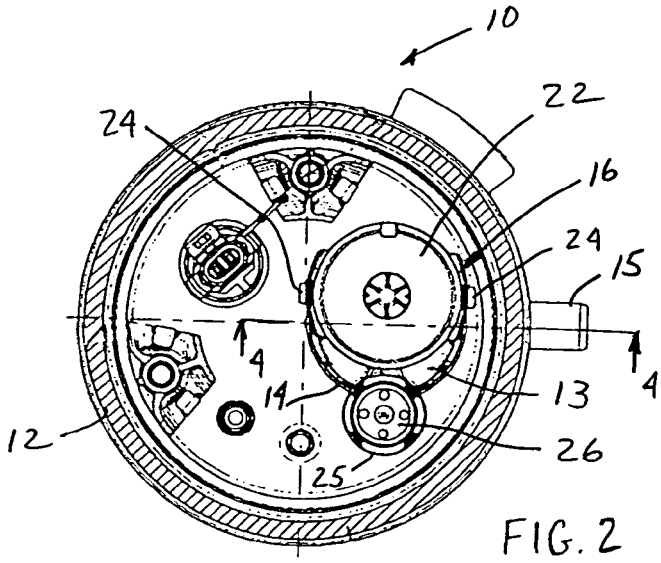
FIG. 2 is bottom view of the flange assembly of FIG. 1.

With reference to FIG. 1, a fuel tank flange assembly is shown, generally indicated at 10, for a fuel supply unit (not shown). The flange assembly includes a metal flange 12 constructed and arranged to close an opening in a fuel tank (not shown). With reference to FIG. 2, the flange 12 has a primary upstanding boss 14 on an interior portion 13 that communicates with an outlet 15 at an exterior of the flange 12. The interior portion 13 is constructed and arranged to be exposed to fuel in the tank.

Figure 3:
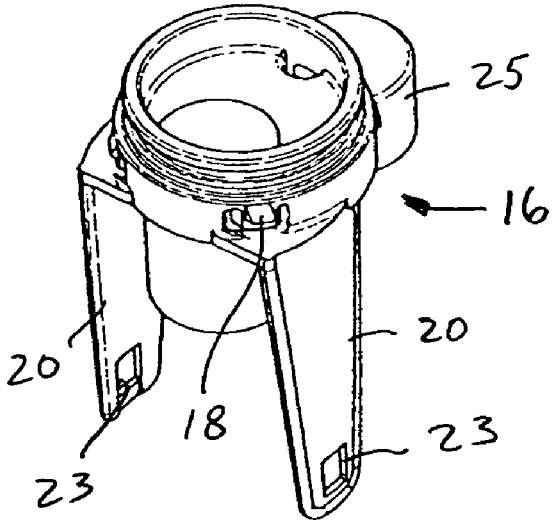
FIG. 3 is a perspective view of the manifold of the flange assembly of FIG. 1 for supporting a component such as a vent valve.

With reference to FIGS. 1 and 3, in accordance with an embodiment of the invention, a preferably plastic manifold, generally indicated at 16, is mounted to the boss 14 so as to communicate with the outlet or port 15. In particular, the boss 14 includes openings (not shown) therein with an associated tab 18 (FIG. 3) of the manifold 16 engaged therewith in preferably a snap-fit arrangement. Two tabs 18 are preferably provided. The manifold 16 is composed of a conventional fuel compatible polymer such as acetal copolymers.

In the illustrated embodiment, the manifold 16 includes at least one upstanding support member 20 that engages a conventional fill limiting vent valve 22. Two support members 20 are shown in the preferred embodiment. Preferably, each support member 20 includes an opening 23 that receives a tab 24 coupled with the valve 22 in a snap arrangement. The valve 22 is a primary vapor venting device that communicates with outlet port 15. Port 15 communicates with a conventional vapor canister (not shown). In addition, the manifold 16 includes a generally cylindrical portion 25 In communication with the outlet 15. The cylindrical portion 25 receives a grade vent valve 26 (FIG. 2). The grade vent valve 26 is constructed and arranged to allow vapor to pass through to the outlet 15, but prevents liquid from passing to the outlet, in the case of a vehicle roll-over event.

Figure 4:
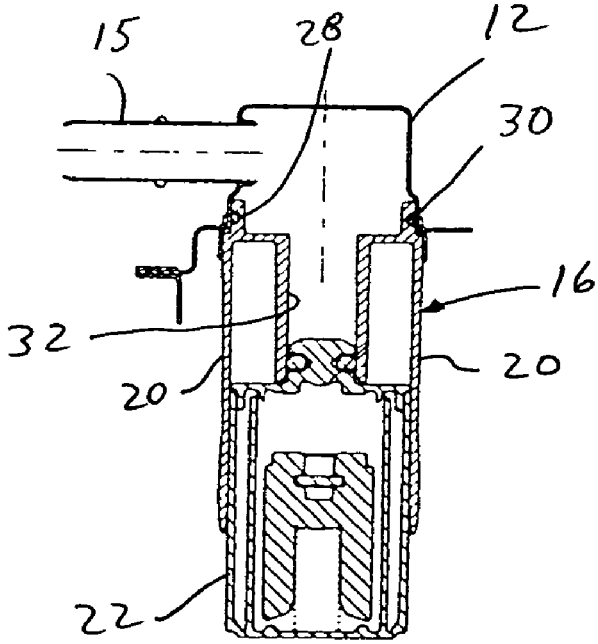
FIG. 4 is a sectional view taken along the line 4-4 in FIG. 2.

With reference to FIG. 4, in order to seal the manifold 16 with respect to the flange 12, the manifold 16 includes an O-ring groove 28 therein and an O-ring 30 is provided in the groove 28 and in contact with a surface of the flange 12. FIG. 4 also shows that the manifold 16 has surfaces defining a generally cylindrical opening 32 that communicates with the outlet 15. A portion of the valve 22 is received in the opening 32.

Although two valves are shown mounted to the manifold, it can be appreciated that other components that are necessary for proper operation of a fuel supply unit can be mounted to the manifold 16. For example, struts 34 (FIG. 1) used to connect upper and lower portions of a fuel supply unit can be coupled to the manifold 16.

The manifold 16 can be employed in fuel tanks for gasoline, ethanol, hybrid or diesel vehicles.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A flange assembly for a fuel supply unit of a vehicle, the assembly comprising:

a flange constructed and arranged to cover an opening in a fuel tank, the flange having an interior portion constructed and arranged to be exposed to fuel, the interior portion being in communication with a vapor receiving outlet provided at an exterior of the flange, a plastic manifold separate from and mounted to the interior portion of the flange so as to communicate with the vapor receiving outlet, the manifold being constructed and arranged to mount at least one fuel supply component thereon, and a seal between the manifold and the interior portion of the flange, wherein the assembly is in combination with a vapor vent valve as the at least one component, the vapor vent valve being separate from and mounted to the manifold and in direct communication with the vapor receiving outlet such that vapor in the fuel tank may pass through the vent valve and to the vapor receiving outlet, and wherein the interior portion includes a boss extending from an interior surface of the flange, the manifold being coupled to the boss in a snap-fit arrangement.

2. The assembly of claim 1, wherein the flange is metal.

3. The assembly of claim 1, in further combination with a grade vent valve constructed and arranged to permit fuel vapor to pass there-through in the event of a vehicle roll-over, the manifold including a portion in communication with the outlet, the portion receiving the grade vent valve.

4. The assembly of claim 1, wherein the seal is an O-ring.

5. The assembly of claim 1, wherein the manifold includes at least one support member constructed and arranged to couple with the vent valve in the snap fit arrangement.

6. The assembly of claim 1, wherein the manifold includes surfaces defining a generally cylindrical opening that communicates with the outlet, a portion of the vent valve being received in the generally cylindrical opening.

7. A flange assembly for a fuel supply unit of a vehicle, the assembly comprising:

a flange constructed and arranged to cover an opening in a fuel tank, the flange having an interior portion constructed and arranged to be exposed to fuel, the interior portion being in communication with a vapor receiving outlet provided at an exterior of the flange, means for mounting at least one fuel supply component thereon, the means for mounting being separate from and coupled to the interior portion of the flange so as to communicate with the vapor receiving outlet, and a seal between the means for mounting and the interior portion of the flange, wherein the assembly is in combination with a vapor vent valve as the at least one component, the vapor vent valve being separate from and mounted to the means for mounting and being in direct communication with the vapor receiving outlet such that vapor in the fuel tank may pass through the vent valve and to the vapor receiving outlet, and wherein the interior portion includes a boss extending from an interior surface of the flange, the means for mounting being coupled to the boss in a snap-fit arrangement.

8. The assembly of claim 7, wherein the flange is of metal material and the means for mounting is of plastic material.

9. The assembly of claim 7, in further combination with a grade vent valve constructed and arranged to permit fuel vapor to pass there-through in the event of a vehicle roll-over, the means for mounting including a portion in communication with the outlet, the portion receiving the grade vent valve.

10. The assembly of claim 7, wherein the seal is an O-ring.

11. The assembly of claim 7, wherein the means for mounting includes at least one support member constructed and arranged to couple with the vent valve in the snap fit arrangement.

12. The assembly of claim 7, wherein the means for mounting includes surfaces defining a generally cylindrical opening that communicates with the outlet, a portion of the vent valve being received in the generally cylindrical opening.

13. A method of providing a flange assembly for a fuel supply unit of a vehicle, the method includes:

providing a flange constructed and arranged to cover an opening in a fuel tank, the flange having an interior portion constructed and arranged to be exposed to fuel, the interior portion being in communication with a vapor receiving outlet provided at an exterior of the flange, mounting a plastic manifold separate from the flange to a boss, extending from the interior portion of the flange, in a snap-fit arrangement so as to communicate with the vapor receiving outlet, providing a seal between the manifold and the flange, and mounting at least one fuel supply component on the manifold, wherein the at least one fuel supply component is a vapor vent valve separate from the manifold and in direct communication with the vapor receiving outlet.

14. The method of claim 13, wherein the step of providing the seal includes providing an O-ring as the seal.

* * * * *